United States Patent [19]

Honda et al.

[11] 4,298,147

[45] Nov. 3, 1981

[54] DISCHARGING MECHANISM FOR MOLTEN METAL AND SLAG REMAINING IN TUNDISH FOR CONTINUOUS CASTING MACHINE

[75] Inventors: Akira Honda, Kamakura; Takanori Anzai, Yokohama; Minoru Kitamura, Fukuyama; Masaru Ishikawa, Fukuyama; Seishi Mizuoka, Fukuyama, all of Japan

[73] Assignee: Nippon Kokan Kabushiki Kaisha, Tokyo, Japan

[21] Appl. No.: 60,882

[22] Filed: Jul. 26, 1979

[30] Foreign Application Priority Data

Aug. 24, 1978 [JP] Japan ..... 53/102330

[51] Int. Cl.[3] ..... B22D 11/10

[52] U.S. Cl. ..... 222/601; 164/437; 164/440

[58] Field of Search ..... 164/440, 337, 437; 222/599, 601, 606; 266/45, 271, 272

[56] References Cited

U.S. PATENT DOCUMENTS

| | | | |
|---|---|---|---|
| 2,426,644 | 9/1947 | Van der Pyl | 266/272 X |
| 2,957,936 | 10/1960 | Bugge | 164/337 X |
| 3,278,999 | 10/1966 | Lemper | 164/440 X |
| 3,421,667 | 1/1969 | Stiteler | 222/601 |
| 3,785,540 | 1/1974 | Donnithorne et al. | 222/601 X |
| 4,079,918 | 3/1978 | Truppe et al. | 266/272 X |

*Primary Examiner*—Robert D. Baldwin
*Assistant Examiner*—J. Reed Batten, Jr.
*Attorney, Agent, or Firm*—Frishauf, Holtz, Goodman & Woodward

[57] ABSTRACT

A discharging mechanism for molten metal and slag remaining in a tundish provided with at least one pouring nozzle for a continuous casting machine, which comprises: a discharging nozzle attached to the bottom wall of the tundish, the nozzle having a discharging bore flaring downwardly for discharging molten metal and slag remaining in the tundish; a frustoconical plug matching with the discharging bore of the discharging nozzle, releasably inserted from outside the bottom wall of the tundish into the discharging bore, a plug fitting being fixed to the lower end of the plug; and a plug engaging means connected with the plug fitting for inserting the plug into the discharging bore of the discharging nozzle, holding same therein and withdrawing same therefrom.

6 Claims, 5 Drawing Figures

DISCHARGING MECHANISM FOR MOLTEN METAL AND SLAG REMAINING IN TUNDISH FOR CONTINUOUS CASTING MACHINE

FIELD OF THE INVENTION

The present invention relates to a discharging mechanism for molten metal and slag remaining in a tundish for a continuous casting machine, particularly a horizontal type continuous casting machine, at or toward the end of casting of molten metal or at the occurrence of a breakout accident of molten metal caused by a breakage of the shell of a non-solidified cast strand, in the casting machine.

BACKGROUND OF THE INVENTION

The continuous casting practice of a molten metal most commonly adopted at present with a continuous casting machine comprises: forming a cast strand by teeming a molten metal, received from a ladle into a tundish, into a mold arranged below a pouring nozzle through said pouring nozzle attached to the bottom wall of the tundish in the form of a downward projection; and withdrawing the cast strand thus formed into a long strand from the lower end of the mold substantially vertically downwardly then horizontally after a curve, while cooling the cast strand. After the completion of casting of the molten metal in the tundish, molten metal and slag remaining in the tundish are discharged and new molten metal is received in the tundish to start the next continuous casting.

The aforementioned discharge of molten metal and slag remaining in the tundish at the end of casting of molten metal is conventionally carried out by discharging the remaining molten metal and slag over the upper edge of the side wall of the tundish while tilting the tundish, or by discharging same through the pouring nozzle.

However, tilting of the tundish requires a large-sized tilting mechanism, which in turn not only requires large installation costs but also leads to a complicated equipment arrangement because of the combination of the tilting mechanism and the other devices of the continuous casting machine. The discharge of molten metal and slag remaining in the tundish through the pouring nozzle results in the pouring nozzle being seriously eroded by the slag. Recently, in particular, an expensive sliding gate comprising refractories is often provided between the bottom wall of the tundish and the pouring nozzle with a view to starting and discontinuing casting of molten metal in the tundish and adjusting the flow rate of the molten metal, and in this case, a problem encountered is that, when discharging molten metal and slag remaining in the tundish through the sliding gate and the pouring nozzle, not only the pouring nozzle but also the sliding gate is seriously eroded by the slag, thus shortening their service life and increasing the operating cost of the tundish.

The above-mentioned conventional continuous casting machine (hereinafter referred to as the "vertical type continuous casting machine") is of the type in which molten metal in the tundish is substantially vertically downwardly cast. Accordingly, the formed cast strand, withdrawn vertically for most of the casting process, although eventually bent horizontally, requires a very large height of the equipment, resulting in a vast investment in construction of the installation including the building. To overcome this inconvenience, a horizontal type continuous casting machine has just been developed principally in an attempt to reduce the construction cost, which comprises: horizontally attaching a pouring nozzle to the lowermost portion of the side wall of a tundish; arranging a mold horizontally on the same axis as the horizontal axis of said pouring nozzle, in close contact with the tip of said pouring nozzle; forming a cast strand by horizontally teeming a molten metal, received into the tundish, into the mold through the pouring nozzle; and withdrawing the cast strand thus formed always horizontally into a long strand while cooling.

Even in the aforementioned horizontal type continuous casting machine, the discharge of molten metal and slag remaining in the tundish at the end of casting of molten metal should, as in the conventional vertical type continuous casting machine, be carried out either by tilting the tundish or by using the pouring nozzle. There are therefore problems similar to those in the conventional vertical type continuous casting machine, such as the necessity of installing a tilting mechanism and the erosion of the pouring nozzle by slag.

Furthermore, in the horizontal type continuous casting machine, it is very difficult, in terms of technology as well as of equipment, to provide a sliding gate for starting and discontinuing casting of molten metal and adjusting the flow rate of the molten metal in the narrow space between the side wall of the tundish and the pouring nozzle. As far as we know, in fact, there is as yet no tundish for a horizontal type continuous casting machine, equipped with such a gate. Therefore, when a breakout accident of molten metal is caused by a breakage of the shell of a non-solidified cast strand downstream the exit of the mold in the conventional vertical type continuous casting machine, the breakout of molten metal can be quickly prevented by closing the gate, thus minimizing the damage caused thereby. In contrast, when such a breakout accident is caused in the horizontal type continuous casting machine, molten metal in the tundish totally flows out through the pouring nozzle and the mold because of the absence of such a gate. In addition, since a water collection channel for cooling water is arranged below the mold exit, molten metal flowing into this channel may cause a serious accident such as a steam explosion.

In the horizontal continuous casting machine, when the surface of molten metal in the tundish becomes lower than the highest point of the inner surface of the mold toward the end of casting of molten metal, a cast strand having a shape matching with the inside diameter of the mold cannot be obtained, resulting in the formation of a portion with a defective shape in the trailing end of a cast strand with a normal shape. This leads to trouble in withdrawing and hot shearing a cast strand.

With these facts in view, development is strongly demanded of a discharging mechanism for molten metal and slag remaining in a tundish for a continuous casting machine, which is capable of easily, certainly, safely and rapidly discharging molten metal and slag remaining in the tundish at or toward the end of casting of molten metal or at the occurrence of a breakout accident of molten metal caused by a breakage of the shell of a non-solidified cast strand. No such discharging mechanism has as yet been proposed.

SUMMARY OF THE INVENTION

An object of the present invention is therefore to provide a discharging mechanism for molten metal and slag remaining in a tundish for a continuous casting machine, which is capable of easily, certainly, safely and rapidly discharging molten metal and slag remaining in the tundish at the end of casting of molten metal.

A principal object of the present invention is to provide a discharging mechanism for molten metal and slag remaining in a tundish for a horizontal type continuous casting machine, which is capable of easily, certainly, safely and rapidly discharging molten metal and slag remaining in the tundish at or toward the end of casting of molten metal or at the occurrence of a breakout accident of molten metal caused by a breakage of the shell of a non-solidified cast strand.

In accordance with one of the features of the present invention, there is provided a discharging mechanism of molten metal and slag remaining in a tundish provided with at least one pouring nozzle for a continuous casting machine, which comprises:

- a discharging nozzle having a discharging bore flaring downwardly, for discharging molten metal and slag remaining in said tundish, attached to the bottom wall of said tundish;
- a frustoconical plug matching with said discharging bore of said discharging nozzle, releasably inserted from outside the bottom wall of said tundish into said discharging bore, a plug fitting being fixed to the lower end of said plug; and,
- a plug engaging means, connected with said plug fitting, for inserting said plug into said discharging bore of said discharging nozzle, holding same therein and withdrawing same therefrom.

DETAILED DESCRIPTION OF PREFERRED EMBODIMENTS

We carried out extensive studies to solve the above-mentioned problems encountered when discharging molten metal and slag remaining in a tundish at the end of casting of molten metal by a continuous casting machine. As a result, we developed a discharging mechanism for molten metal and slag remaining in a tundish provided with at least one pouring nozzle for a continuous casting machine.

The discharging mechanism for molten metal and slag remaining in the tundish for the continuous casting machine of the present invention (hereinafter referred to as the "discharging mechanism of the present invention") is described below with reference to the drawings.

Figure 1:
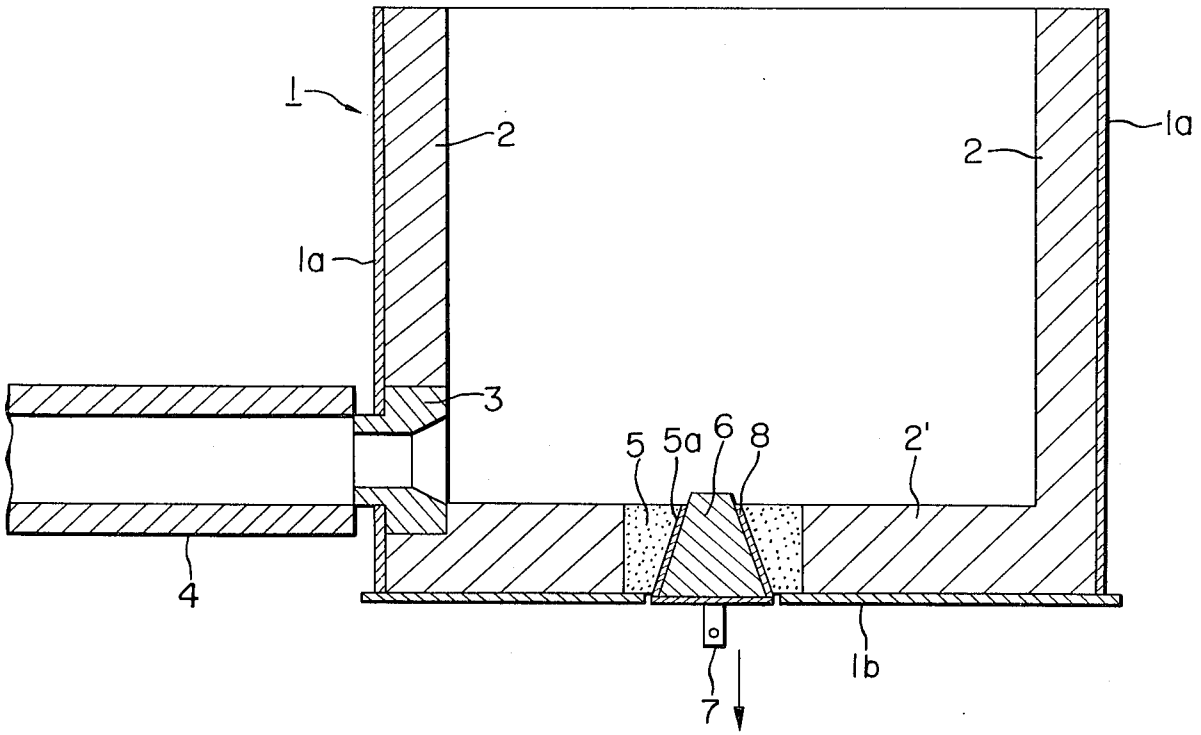
FIG. 1 is a longitudinal schematic sectional view illustrating the fundamental structure of the discharging mechanism of the present invention for discharging molten metal and slag remaining in a tundish for a continuous casting machine (hereinafter referred to as the "discharging mechanism of the present invention"), the tundish being for a horizontal type continuous casting machine.

FIG. 1 is a longitudinal schematic sectional view illustrating the fundamental structure of the discharging mechanism of the present invention for a tundish for a horizontal type continuous casting machine. In FIG. 1, 1 is a tundish; 2 is a side wall of the tundish 1; 2' is a bottom wall of the tundish 1, both the side wall 2 and the bottom wall 2' being formed of refractories; 1*a* and 1*b* are steel plates respectively covering the side wall 2 and the bottom wall 2'; 3 is a pouring nozzle made of a refractory horizontally attached to the lowermost portion of the side wall 2 on one side; and, 4 is a water-cooled copper mold arranged horizontally on the same axis as the horizontal axis of the pouring nozzle 3, in close contact with the tip of the pouring nozzle 3.

As shown in FIG. 1, a discharging nozzle 5 made of a refractory having a discharging bore 5*a* outwardly flaring downwardly, for discharging molten metal and slag remaining in the tundish 1, is attached to the bottom wall 2' of the tundish 1, and a plug 6 made of a refractory having a frustoconical shape which matches with the discharging bore 5*a* of the discharging nozzle 5 is releasably inserted from outside the bottom wall 2' of the tundish 1 into said discharging bore 5*a*. A plug fitting 7 is fixed to the lower end of the plug 6 in the form of a downward projection. The plug 6 is inserted into the discharging bore 5*a* of the discharging nozzle 5 by a plug engaging means described later connected to the plug fitting 7, held therein and withdrawn therefrom.

The discharging mechanism of the present invention comprises three component parts: the discharging nozzle 5 and the plug 6 mentioned above and the plug engaging means described later. More specifically, as shown in FIG. 1, the discharging bore 5*a* is closed by inserting the plug 6, after coating the outer surface thereof with mortar 8, into the discharging bore 5*a* of the discharging nozzle 5 from outside the bottom wall 2' of the tundish 1, and the plug 6 is held in place by the plug engaging means described later connected to the plug fitting 7. Then, molten metal is received into the tundish 1 and teemed into the mold 4 through the pouring nozzle 3. Upon the completion of teeming of the molten metal, molten metal and slag remaining in the tundish 1 is easily, certainly, safely and rapidly discharged through the discharging bore 5*a* of the discharging nozzle 5 into a previously prepared container or trough by withdrawing plug 6 downwardly, as shown by an arrow in FIG. 1, from the discharging bore 5*a* of the discharging nozzle 5 by means of the plug engaging means described later. When a breakout accident of molten metal is caused by a breakage of the shell of a non-solidified cast strand, a more serious accident such as a steam explosion can be avoided by rapidly discharging molten metal and slag remaining in the tundish 1 in a manner similar to that described above.

Figure 2:
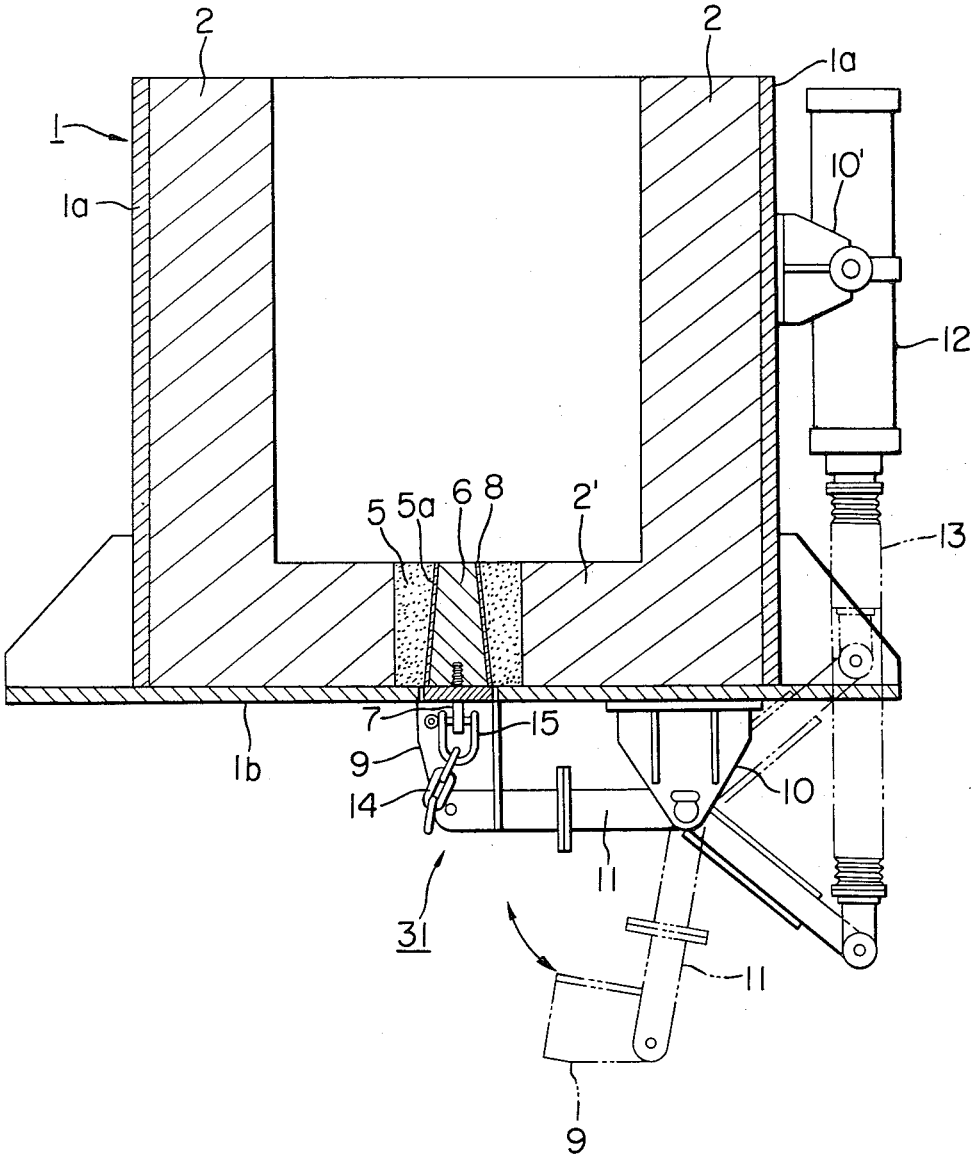
FIG. 2 is a transverse schematic sectional view illustrating an embodiment of the discharging mechanism of the present invention for a tundish for use in a horizontal type continuous casting machine.

FIG. 2 is a transverse schematic sectional view illustrating an embodiment of the discharging mechanism of the present invention for the tundish for a horizontal type continuous casting machine. In FIG. 2, as in FIG. 1, 1 is a tundish; 2 is a side wall of the tundish 1; 2' is a form of a projection from the levers 11*a* and 11*b*, and a hole 25 is provided at the tip of the plug fitting 7 projecting out from the levers 11*a* and 11*b*. A pin 26 is inserted into the hole 25, to be in contact with the lower surface of the levers 11*a* and 11*b*. The plug 6 is thus connected to the levers 11*a* and 11*b* by the pin 26.

Figure 3:
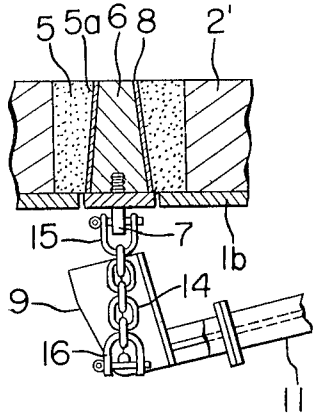
FIG. 3 is a descriptive drawing of a portion of FIG. 2.
Figure 4:
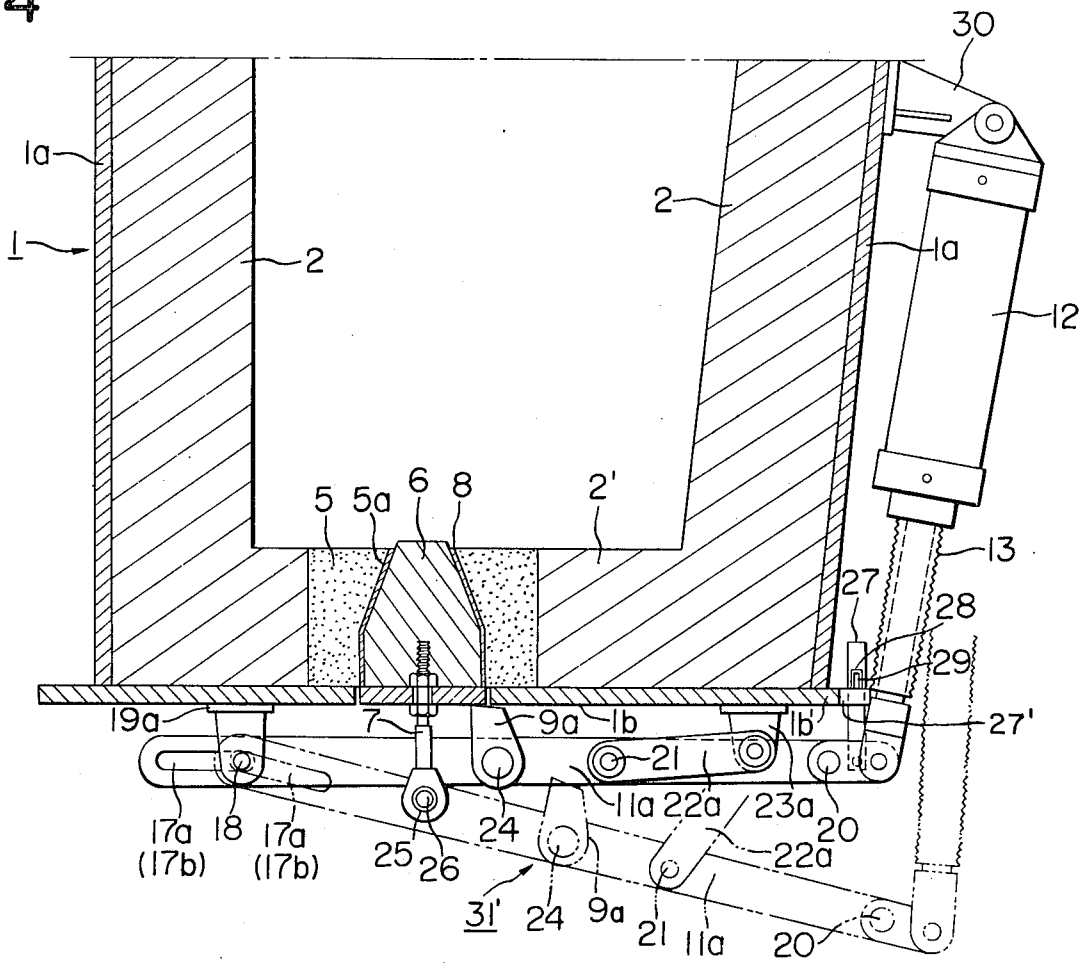
FIG. 4 is a transverse schematic sectional view illustrating another embodiment of the discharging mechanism of the present invention for a tundish for a horizontal type continuous casting machine; and, FIG. 5 is a bottom view of an important portion of the discharging mechanism of the present invention shown in FIG. 4.

Although not being one of the indispensable component parts of the discharging mechanism of the present invention, a locking means should preferably be provided for the cylinder 12 and the flexible rod 13 from safety considerations. In FIG. 4, for example, 27 is a locking bar, and 27' is a notch provided in a flange 1*b'* of the steel plate 1*b* covering the bottom wall 2' of the tundish 1. A cotter hole 28 is provided in the locking bar 27, of which an end is bent in a hook shape. The cylinder 12 and the flexible rod 13 are locked by inserting the locking bar 27 into the notch 27', hooking the end of the locking bar 27 on a hole provided at the end of the lever 11*a*, and driving a cotter pin 29 into the cotter hole 28 to be in contact with the upper surface of the flange 1*b'*. The locking means is not limited to the above-mentioned structure, but any locking means may be applied which permits secured locking of the cylinder 12 and the flexible rod 13 and rapid release of locking. A locking means such as the one described above should preferably be installed also in the discharging mechanism of FIGS. 2 and 3 from the point of view of safety.

Since the plug engaging means 31' has the structure as mentioned above, the plug 6 is engaged into the discharging bore 5*a* of the discharging nozzle 5 as follows. The levers 11*a* and 11*b* are lowered to the position shown by chain lines in FIG. 4, with the axle 18 as the fulcrum, by first unlocking the cylinder 12 and the flexible rod 13 by withdrawing the cotter pin 29 of the locking means, and then causing the flexible rod 13 to expand through the actuation of the cylinder 12, thereby to separate the plug stopper 9*a* fixed to the levers 11*a* and 11*b* from the lower surface of the tundish 1. Then, the plug 6 is inserted manually, after coating the outer surface thereof with the mortar 8, into the discharging bore 5*a* of the discharging nozzle 5 from outside the bottom wall 2' of the tundish. Then, the levers 11*a* and 11*b* are raised, with the axle 18 as the fulcrum, by causing the flexible rod 13 to contract through the actuation of the cylinder 12, thereby to firmly insert the plug 6 into the discharging bore 5*a* of the discharging nozzle 5 and hold the plug 6 therein so as not to allow it to drop out therefrom by the plug stopper 9*a* fixed to the levers 11*a* and 11*b*. Then, the pin 26 is inserted into the hole 25 provided at the tip of the plug fitting 7 to be in contact with the lower surface of the levers 11*a* and 11*b*. Then, the cylinder 12 and the flexible rod 13 are locked by inserting the locking bar 27 into the notch 27' provided in the flange 1*b'* of the steel plate 1*b*, hooking the hook at the end of the locking bar 27 on the hole provided at the end of the lever 11*a*, and driving the cotter 29 into the cotter pin hole 28 to be in contact with the upper surface of the flange 1*b'*.

After the plug 6 is engaged into the discharging bore 5*a* of the discharging nozzle 5 in the manner as mentioned above, molten metal is received into the tundish 1, and, as previously mentioned with reference to FIG. 1, the molten metal in the tundish 1 is teemed into the mold 4 through the pouring nozzle 3.

Discharge of molten metal and slag remaining in the tundish 1 at or toward the end of teeming of molten metal in the tundish 1 or at the occurrence of a breakout accident of molten metal caused by a breakage of the shell of a non-solidified cast strand is effected by withdrawing the plug 6 from the discharging bore 5*a* of the discharging nozzle 5 in the manner as mentioned below. More specifically, as shown in FIG. 4, the cylinder 12 and the flexible rod 13 are unlocked by withdrawing the cotter pin 29 from the hole 28 of the locking bar 27. Then, the levers 11*a* and 11*b* are lowered to the chain line position shown in FIG. 4, with the axle 18 as the fulcrum, by causing the flexible rod 13 to expand through the actuation of the cylinder 12. As a result, the plug stopper 9*a* holding the plug 6 is separated from the lower surface of the plug 6, and at the same time, the pin 26 inserted into the hole 25 of the plug fitting 7 fixed to the lower end of the plug 6 is lowered by the levers 11*a* and 11*b*, and thus the plug 6 is withdrawn from the discharging bore 5*a* of the discharging nozzle 5. Consequently, molten metal and slag remaining in the tundish 1 are discharged through the discharging bore 5*a* of the discharging nozzle 5 into a previously prepared container or trough (not shown).

In the embodiments described above, the discharging mechanism of the present invention has been described as to the application to a tundish for a horizontal type continuous casting machine. It is needless to mention that the discharging mechanism of the present invention is applicable also to a tundish for a vertical type continuous casting machine in just the same manner as described above.

According to the discharging mechanism of the present invention, as described above in detail, when discharging molten metal and slag remain in a tundish at the end of casting of molten metal in the tundish, it is not necessary to tilt the tundish by a large-sized tilting mechanism as in conventional cases, and it is possible not only to easily, certainly, safely and rapidly discharge molten metal and slag remaining in a tundish with a simple and low-cost mechanism, but also to extend the service life of a pouring nozzle and an expensive sliding gate through the prevention of erosion thereof caused by slag. Particularly, application of the discharging mechanism of the present invention to a tundish for a horizontal type continuous casting machine not only permits avoidance of inconveniences in withdrawing and hot shearing a cast strand through the prevention of the occurrence of a defective-shaped cast strand toward the end of casting of molten metal, but also permits rapid discharge of molten metal and slag remaining in a tundish at the occurrence of a breakout accident of molten metal caused by a breakage of the shell of a non-solidified cast strand, thus enabling to avoid such a serious accident as a steam explosion. According to the discharging mechanism of the present invention, as mentioned above, there are provided many industrially useful effects.

What is claimed is:

1. A discharging mechanism for molten metal and slag remaining in a tundish provided with at least one pouring nozzle for a continuous casting machine, comprising:

a discharging nozzle having a discharging bore outwardly flaring downwardly, for discharging molten metal and slag remaining in said tundish, said discharging nozzle being attached to the bottom wall of said tundish substantially at the center of said bottom wall, said discharging nozzle being separate and distinct from said pouring nozzle and bottom wall of the tundish 1; 1*a* and 1*b* are steel plates respectively covering the side wall 2 and the bottom wall 2'; 5 is a discharging nozzle having a discharging bore 5*a* outwardly flaring downwardly, attached to the bottom wall 2' of the tundish 1; 6 is a plug inserted into the discharging bore 5*a* of the discharging nozzle 5; 7 is a plug fitting fixed to the lower end of the plug 6; and, 8 is mortar coated onto the outer surface of the plug 6.

An embodiment 31 of the plug engaging means which is one of the component parts of the discharging mechanism of the present invention has a structure as shown in FIG. 2 and as described below. More specifically, 9 is a plug stopper for inserting the plug 6 into the discharging bore 5*a* of the discharging nozzle 5 and holding said plug 6 therein so as not to allow it to drop out therefrom; 11 is a lever arranged substantially horizontally below the tundish 1; 12 is a cylinder connected via an axle substantially vertically to a support 10' fixed to the steel plate 1*a* covering the side wall 2 of the tundish 1; and, 13 is a flexible rod of the cylinder 12. The plug stopper 9 is fixed to an end of the lever 11 at a position below the plug 6. The tip of the flexible rod 13 is connected via an axle to the other end of the lever 11. The lever 11, substantially at the center thereof, is connected via an axle to a support 10 fixed to the lower surface of the steel plate 1*b* covering the bottom wall 2' of the tundish 1. An end of a chain 14 is attached, by means of a shackle 15, to the plug fitting 7 fixed to the lower end of the plug 6, and the other end of the chain 14 is attached, by means of another shackle 16 (see FIG. 3) to the end of the lever 11 fixed with the plug stopper 9. The plug 6 is thus connected to the end of the lever 11 by the chain 14.

In the FIG. 2 embodiment, the plug 6 is engaged into the discharging bore 5*a* of the discharging nozzle 5 as follows. The end of the lever 11 fixed with the plug stopper 9 is first lowered to the position shown by chain lines in FIG. 2, with the support 10 as the fulcrum, by causing the flexible rod 13 to contract through the actuation of the cylinder 12, thereby to separate the plug stopper 9 fixed to the end of the lever 11 from the lower surface of the tundish 1. Then, the plug 6 is inserted manually, after coating the outer surface thereof with the mortar 8, into the discharging bore 5*a* of the discharging nozzle 5 from outside the bottom wall 2' of the tundish 1. Then, the end of the lever 11 fixed with the plug stopper 9 is raised to the position shown by solid lines, with the support 10 as the fulcrum, by causing the flexible rod 13 to expand through the actuation of the cylinder 12, thereby to firmly insert the plug 6 into the discharging bore 5*a* of the discharging nozzle 5 and hold the plug 6 therein so as not to allow it to drop out therefrom by the plug stopper 9 fixed to the end of the lever 11. Then, both ends of the chain 14 are attached respectively to the end of the plug fitting 7 of the plug 6 and the end of the lever 11 by the shackles 15 and 16. The plug 6 is thus connected to the end of the lever 11 by the chain 14.

After the plug 6 is engaged into the discharging bore 5*a* of the discharging nozzle 5 in the manner as mentioned above, molten metal is received into the tundish 1, and, as previously mentioned with reference to FIG. 1, the molten metal in the tundish 1 is teemed into the mold 4 through the pouring nozzle 3.

Discharge of molten metal and slag remaining in the tundish 1 at or toward the end of teeming of molten metal in the tundish 1 or at the occurrence of a breakout accident of molten metal caused by a breakage of the shell of a non-solidified cast strand is carried out by withdrawing the plug 6 from the discharging bore 5*a* of the discharging nozzle 5 in the manner as mentioned below. More specifically, as shown in FIG. 2, the end of the lever 11 fixed with the plug stopper 9 is lowered to the position shown by chain lines with the support 10 as the fulcrum, by causing the flexible rod 13 to contract by actuating the cylinder 12. As a result, as shown in the partial descriptive drawing of FIG. 3, the plug stopper 9 holding the plug 6 is separated from the lower surface of the plug 6, and then, as the lever 11 is lowered, the plug 6 is pulled by the chain 14 connected to the plug fitting 7 fixed to the lower end of the plug 6, and thus the plug 6 is withdrawn from the discharging bore 5*a* of the discharging nozzle 5. Consequently, molten metal and slag remaining in the tundish 1 are discharged through the discharging bore 5*a* of the discharging nozzle 5 into a previously prepared container or trough (not shown). In FIG. 3, as in FIG. 2, 2' is a bottom wall of the tundish 1; 1*b* is a steel plate covering the bottom wall 2' of the tundish 1; 7 is a plug fitting fixed to the lower end of the plug 6; 8 is mortar coated onto the outer surface of the plug 6; and, 15 and 16 are shackles.

Figure 5:
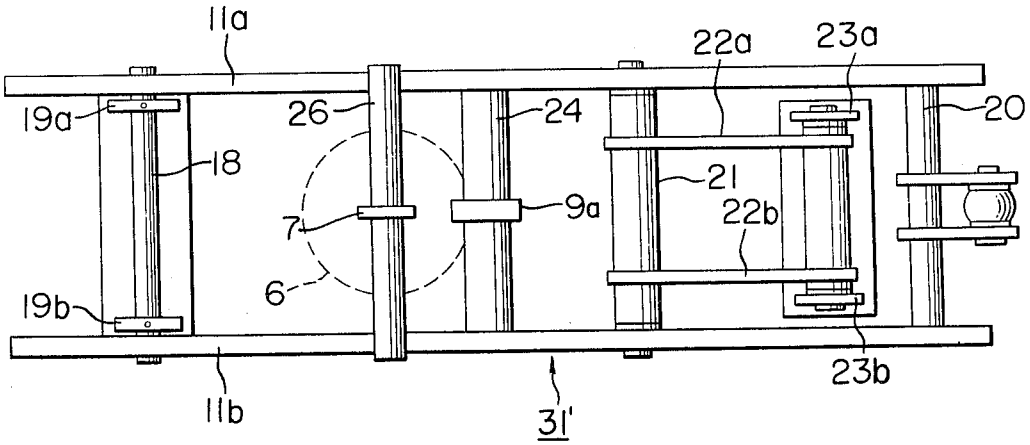

FIG. 4 is a transverse schematic sectional view illustrating another embodiment of the discharging mechanism of the present invention for the tundish for a horizontal type continuous casting machine; and, FIG. 5 is a bottom view of an important portion of the discharging mechanism shown in FIG. 4. In FIGS. 4 and 5, as in FIG. 1, 1 is a tundish for a horizontal type continuous casting machine; 2 is a side wall of the tundish 1; 2' is a bottom wall of the tundish 1; 1*a* and 1*b* are steel plates respectively covering the side wall 2 and the bottom wall 2'; 5 is a discharging nozzle having a discharging bore 5*a* outwardly flaring downwardly, attached to the bottom wall 2' of the tundish 1; 6 is a plug inserted into the discharging bore 5*a* of the discharging nozzle 5; 7 is a plug fitting fixed to the lower end of the plug 6; and, 8 is mortar coated onto the outer surface of the plug 6.

In FIGS. 4 and 5, 11*a* and 11*b* are a pair of levers arranged in parallel with each other and substantially horizontally below the tundish 1 at positions with the plug 6 in between them, and slits 17*a* and 17*b* are provided respectively at one end of said levers 11*a* and 11*b*. An axle 18 is horizontally laid across a space between holes respectively provided at ends of supports 19*a* and 19*b* fixed to the lower surface of the steel plate 1*b* covering the bottom wall 2' of the tundish 1 and the slits 17*a* and 17*b* of the levers 11*a* and 11*b*, and thus, the ends of the levers 11*a* and 11*b* are slidably connected via the axle 18 to the supports 19*a* and 19*b*. The other ends of the levers 11*a* and 11*b* are connected via an axle 20 to the tip of a flexible rod 13 of a cylinder 12 which is connected via an axle substantially vertically to a support 30 fixed to the steel plate 1*a* covering the side wall 2 of the tundish 1. The levers 11*a* and 11*b*, substantially at the center thereof, are connected via an axle 21 and branch levers 22*a* and 22*b* to supports 23*a* and 23*b* fixed to the lower surface of the steel plate 1*b* covering the bottom wall 2' of the tundish 1.

A fixed axle 24 is laid across the space between the levers 11*a* and 11*b* at a position below the plug 6, and a plug stopper 9*a* is fixed to the center of the fixed axle 24 for inserting the plug 6 into the discharging bore 5*a* of the discharging nozzle 5 and holding the plug 6 therein so as not to allow it to drop out therefrom.

The plug fitting 7 fixed to the lower end of the plug 6 has a length sufficient for the tip thereof to take the being operable independently of said pouring nozzle;

a frustoconical plug mating with said discharging bore of said discharging nozzle, and being releasably inserted from outside said bottom wall of said tundish into said discharging bore;

a plug fitting fixed to the lower end of said plug; and a plug engaging means connected to said plug fitting for selectively inserting said plug into said discharging bore of said discharging nozzle, holding said plug in said discharging bore of said discharging nozzle and withdrawing said plug from said discharging bore of said discharging nozzle, said plug engaging means including:

first and second pairs of supports fixed to the lower surface of the bottom wall of said tundish;

a pair of levers arranged in parallel with each other and substantially horizontally below said tundish at positions which said plug located therebetween, said pair of levers, at a first end portion thereof being respectively slidably connected via an axle to said first pair of supports, and, substantially at the center of said pair of levers, being connected via an axle and a pair of branch levers to said second pair of supports;

a plug stopper for inserting said plug into said discharging bore of said discharging nozzle and holding same therein so as not to allow it to drop out therefrom, said plug stopper being fixed, at a position below said plug, to the center of a fixed axle extending across the space between said pair of levers;

a cylinder and a flexible rod, said cylinder being connected via an axle, substantially vertically to a further support fixed to the outer surface of the side wall of said tundish, and, the end portion of said flexible rod being connected via an axle to the other end portion of said pair of levers;

said plug fitting having a hole at an end portion thereof; and a pin inserted into said hole in said plug fitting and projecting out from said pair of levers, said pin being inserted into said hole to be in contact with the lower surface of said pair of levers, thereby coupling said plug to said pair of levers;

whereby said plug is firmly inserted into said discharging bore of said discharging nozzle and held therein so as not to allow it to drop out therefrom by means of said plug stopper, by raising said pair of levers, with end portions thereof as the fulcrum, by causing said flexible rod to contract through the actuation of said cylinder; and on the other hand, said plug is withdrawn from said discharging bore of said discharging nozzle by means of said pin, by lowering said pair of levers, with end portions thereof as the fulcrum, by causing said flexible rod to expand through the actuation of said cylinder.

2. The discharging mechanism of claim 1, wherein said cylinder and said flexible rod are provided with a locking means.

3. The discharging mechanism of claim 1, wherein said tundish is a tundish for a vertical type continuous casting machine.

4. The discharging mechanism of claim 3, wherein said cylinder and said flexible rod are provided with a locking means.

5. The discharging mechanism of claim 1, wherein said tundish is a tundish for a horizontal type continuous casting machine.

6. The discharging mechanism of claim 5, wherein said cylinder and said flexible rod are provided with a locking means.

* * * * *